US008720333B2

(12) United States Patent
Henn et al.

(10) Patent No.: US 8,720,333 B2
(45) Date of Patent: May 13, 2014

(54) BUFFERING AND TENSION CONTROL SYSTEM AND METHOD

(75) Inventors: Nissim Henn, Nes Ziona (IL); Yoram Hart, Shoham (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 1365 days.

(21) Appl. No.: 11/740,691

(22) Filed: Apr. 26, 2007

(65) Prior Publication Data

US 2008/0264995 A1 Oct. 30, 2008

(51) Int. Cl.
*B41F 13/02* (2006.01)
*B41F 13/04* (2006.01)

(52) U.S. Cl.
USPC ..... 101/228; 101/232; 101/278; 101/279

(58) Field of Classification Search
USPC ..... 101/228, DIG. 42, 232, 278, 279
See application file for complete search history.

(56) References Cited

U.S. PATENT DOCUMENTS 5,016,182 A * 5/1991 Bergland et al. ..... 700/125
5,663,510 A * 9/1997 Niemann et al. ..... 73/862.55
6,334,390 B1 * 1/2002 Schaede ..... 101/228
6,352,614 B1 * 3/2002 Linnonmaa et al. ..... 162/193
6,473,669 B2 * 10/2002 Rajala et al. ..... 700/122
6,499,397 B2 * 12/2002 Stern ..... 101/248
6,662,721 B2 * 12/2003 Fujishiro ..... 101/228
7,017,486 B2 * 3/2006 Steffen et al. ..... 101/228
7,494,122 B2 * 2/2009 Spinetti ..... 271/216
2002/0008173 A1 * 1/2002 Burri et al. ..... 242/420.6
2002/0059013 A1 * 5/2002 Rajala et al. ..... 700/122
2002/0063541 A1 * 5/2002 Cote et al. ..... 318/432
2003/0052148 A1 * 3/2003 Rajala et al. ..... 226/44
2004/0074407 A1 * 4/2004 Iyokawa et al. ..... 101/228
2004/0074942 A1 * 4/2004 Sorebo et al. ..... 226/118.2
2004/0109267 A1 * 6/2004 Habetler ..... 361/23
2005/0068362 A1 * 3/2005 Otokita ..... 347/19
2005/0127126 A1 * 6/2005 Hanson ..... 226/188
2005/0139713 A1 * 6/2005 Weber et al. ..... 242/418.1
2005/0242760 A1 * 11/2005 Fujita et al. ..... 318/434
2006/0174792 A1 * 8/2006 Brost et al. ..... 101/488

* cited by examiner

*Primary Examiner* — David Banh

(57) ABSTRACT

A method of buffering and controlling the tension of a print substrate moving through a web press comprises: supporting a loop of print substrate on a movable roller, wherein translational movement of the roller is controlled by a motor; and controlling the motor to achieve a sequence of roller movements arranged to control tension of the substrate during a sequence of variations in substrate velocity during a printing cycle.

20 Claims, 3 Drawing Sheets

BUFFERING AND TENSION CONTROL SYSTEM AND METHOD

FIELD OF THE INVENTION

The present invention relates to a method of buffering and controlling the tension of a web substrate, and in particular of a web substrate moving through a print cycle of a web press.

BACKGROUND TO THE INVENTION

In a semi rotary printing process the web substrate moves during image transfer at a printing process speed, decelerates, stops and moves backwards and accelerates for the next printing image. The change in velocity and resulting changes in the tension of the web substrate cause problems, particularly when printing a number of repeating images of a particular size, for example as labels. Variations in substrate tension will cause stretching and contraction of the web substrate and result in images of varying sizes. This process therefore requires a buffering system to compensate for variations in the web flow velocity and a system for controlling the tension of the web. A known passive system is the use of vacuum boxes at the web feed and exit sections of the printing system, in which the vacuum applies tension to the web substrate by pulling a loop of the web substrate towards the back of the vacuum box so that the length of the loop pulled into the box varies to accommodate slack and maintain the tension in the web. However, in such a system there is a varying degree of friction between the walls of the vacuum box and the web substrate that is dependent on the direction of flow of the substrate.

SUMMARY OF THE INVENTION

The present invention provides a method of buffering and controlling the tension of a print substrate moving through a web press with a sequence of variations in substrate velocity during a printing cycle, using a control system comprising a chassis, a movable roller and a motor, the method comprising: supporting a loop of the print substrate on the movable roller; controlling translational movement of the roller with the motor; and controlling the motor output to achieve a sequence of roller movements arranged to control tension of the substrate during the sequence of variations in velocity.

Preferably, the method further comprises receiving a user input, determining a sequence of roller movements on the basis of the user input and controlling the roller to follow the sequence of roller movements. The roller may be mounted on a movable cradle driven by the motor.

The method may comprise measuring the position of the cradle and controlling the output of the motor in response to the measured position to control the velocity of the cradle to achieve the predetermined sequence of roller movements. This, combined with computing and compensating for the dynamics of the movable cradle, provides an active closed loop method of tension control.

The motor output may be controlled on the basis of a factor, which depends on the required tension. The motor output may also be controlled on the basis of a factor, which depends on the acceleration of at least the cradle. Alternatively, or additionally, the motor output may be controlled on the basis of a factor, which varies with at least one of the position and velocity of the cradle to compensate for changes in friction. The method may comprise sensing the position of the motor to measure the position of the cradle.

The method may comprise moving the control system through a calibration cycle, during which the system learns a sequence of variations of friction as a function of at least one of the position and velocity of the roller and learns the inertia of the system, and determining a plurality of functions describing movements in the system/The sequence of roller movements may be determined using the plurality of functions. The motor output may be controlled by controlling a current supplied to the motor.

The method may further comprise sensing the temperature of the motor and controlling the current applied to the motor in response to changes in temperature to maintain the motor torque at a desired or target level.

Preferably, the tension of the print substrate may be controlled on both an input side and an output side of the web press.

The method may further comprise monitoring the supplied current to detect irregularities that may be indicative of a fault.

According to a second aspect of the invention, there is provided a control system for buffering and tension control of a length of print substrate passing through a web press, the control system comprising a chassis, a movable roller arranged to support a loop of the print substrate, a cradle arranged to hold the movable roller, a motor arranged to drive the cradle to produce translational movement of the roller, measuring means arranged to measure the translational position of the roller and control means arranged to control the motor to achieve a sequence of roller movements to maintain tension during a sequence of variations in substrate velocity.

Preferably, the system further comprises a user input, wherein the control means is arranged to receive the user input and calculate a sequence of roller movements on the basis of the user input.

The control means may be arranged to control a current supplied to the motor to control the output of the motor. Preferably, the system further comprises a temperature sensor arranged to sense a temperature of the motor, wherein the control means is arranged to control the current supplied to the motor in response to variations in the temperature of the motor to maintain the motor output.

The cradle may be supported on the chassis and the control means may be arranged to control the motor output on the basis of at least one of a first factor which depends on the tension of the substrate, a second factor which varies with the acceleration of at least the cradle and a third factor which varies with at least one of the position and the velocity of the cradle so as to compensate for any changes in friction.

The cradle may be arranged to slide along the chassis on linear bearings and the system may further comprise at least two fixed rollers, wherein the movable roller is arranged to tension the substrate against the fixed rollers. Preferably, the system further comprises at least one energy absorber at each end of travel of the cradle and may further comprise at least one limit switch arranged to detect the end of travel of the cradle.

Preferably, the system is arranged to control the tension and velocity of a substrate on an input side of a web press and further comprises a second system including a movable roller arranged to control the tension and velocity of the substrate on an output side of the web press.

The control means may include a memory having stored therein a plurality of different control settings for use with respective substrate types.

The chassis may be orientated substantially vertically, or alternatively may be orientated substantially horizontally, or at any angle between the horizontal and vertical.

Preferred embodiments of the invention will now be described with reference to the drawings.

DESCRIPTION OF THE PREFERRED EMBODIMENTS

Figure 1:
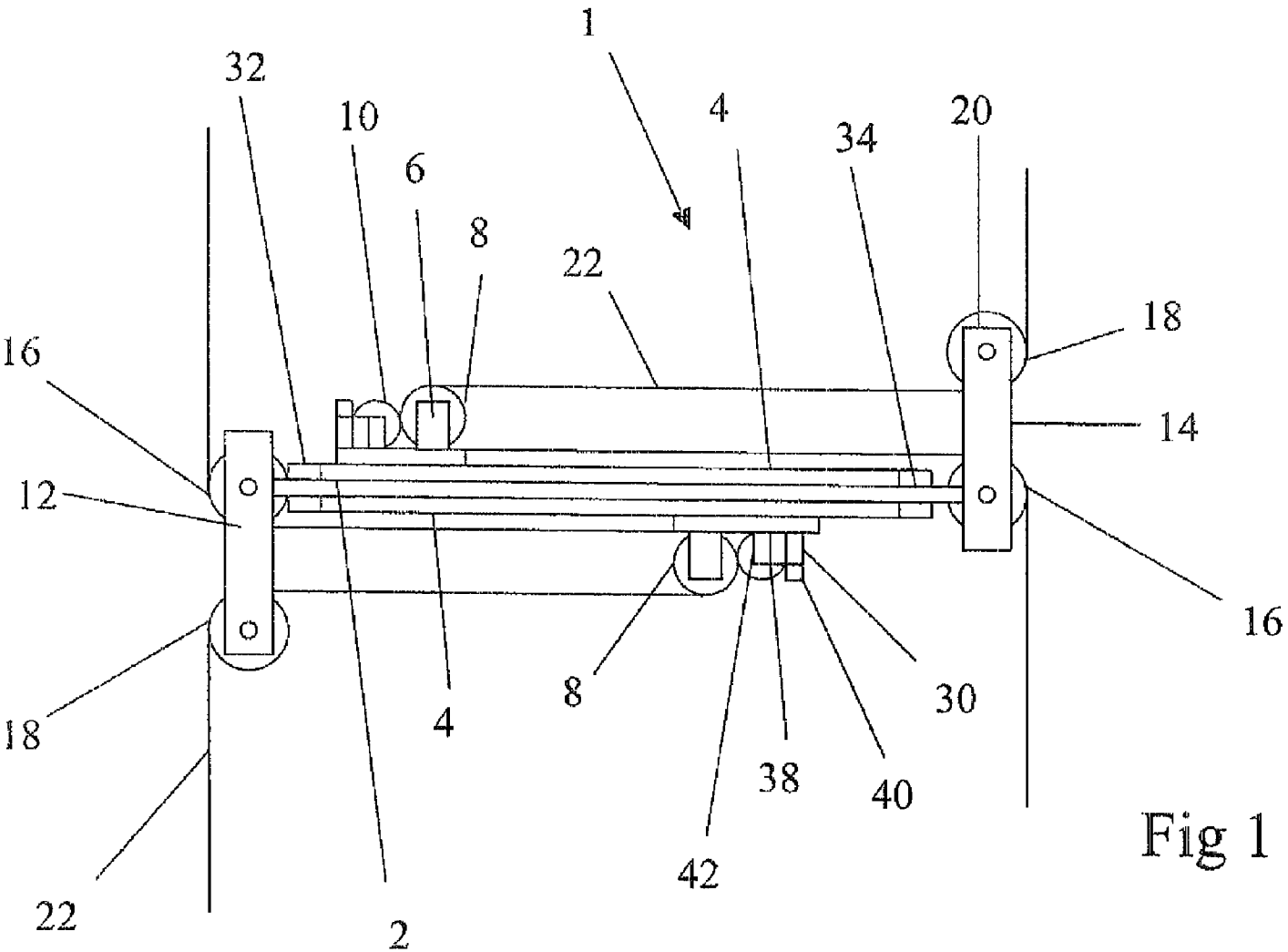
FIG. 1 is a schematic representation of a buffering and tension system of an embodiment of the present invention.

Referring to FIG. 1, the control system 1 comprises two buffering systems mounted on a chassis 2. A first buffering system is mounted on top of the chassis 2 and a second on the underside of the chassis. The two buffering systems are the same and corresponding parts are indicated by the same reference numerals. The first buffering system comprises two rails 4 mounted on the chassis and extending along the sides of the chassis, and a movable cradle 6 extending across the width of the chassis and slidably mounted on the rails. The cradle 6 supports a movable roller 8, which extends across the width of the chassis and is held such that it can rotate about its central axis. The roller axis is perpendicular to the rails 4 and to the direction of motion of the cradle 6. A bi-directional motor 10 is mounted at a first end 12 of the chassis and drives the cradle along the rails using a drive belt mechanism, thereby controlling translational movement of the roller.

At a second end 14 of the chassis 2 are two fixed rollers 16, 18, which extend across the width of the chassis. The two rollers 16, 18 are spaced apart and extend parallel to each other and parallel to the movable roller 8. The second fixed roller 18 is supported above the first fixed roller by a support frame 20 mounted on the chassis 2.

A second buffering system including a second movable roller is mounted underneath the chassis 2 and corresponds to the first control system.

The chassis 6 is substantially horizontal. However, since the system does not rely on gravity, it will be appreciated that the chassis 6 may be orientated at an alternative angle, for example vertically.

In use, a web substrate 22 is fed into the buffering system turning through 90° round the first fixed roller 16, runs along the length of the chassis 2 and is fed under the movable roller 8. The web 22 passes upwards turning through 180° around the movable roller 8, runs back along the length of the chassis and is fed under the second fixed roller 18, turns through 90° around the second fixed roller 18, and from there is fed into the printing press. The movable roller 8 tensions the web substrate 22 against the two fixed rollers 16, 18 and the arrangement forms a web loop, the size of which can be changed by driving the movable cradle 6 along the rails 4 to control the amount of web substrate accommodated in the loop. For example, driving the cradle along the rails towards the fixed rollers 16, 18 decreases the length of the web loop and driving the cradle back away from the fixed rollers 16, 18 increases the length of the web loop.

Figure 2:
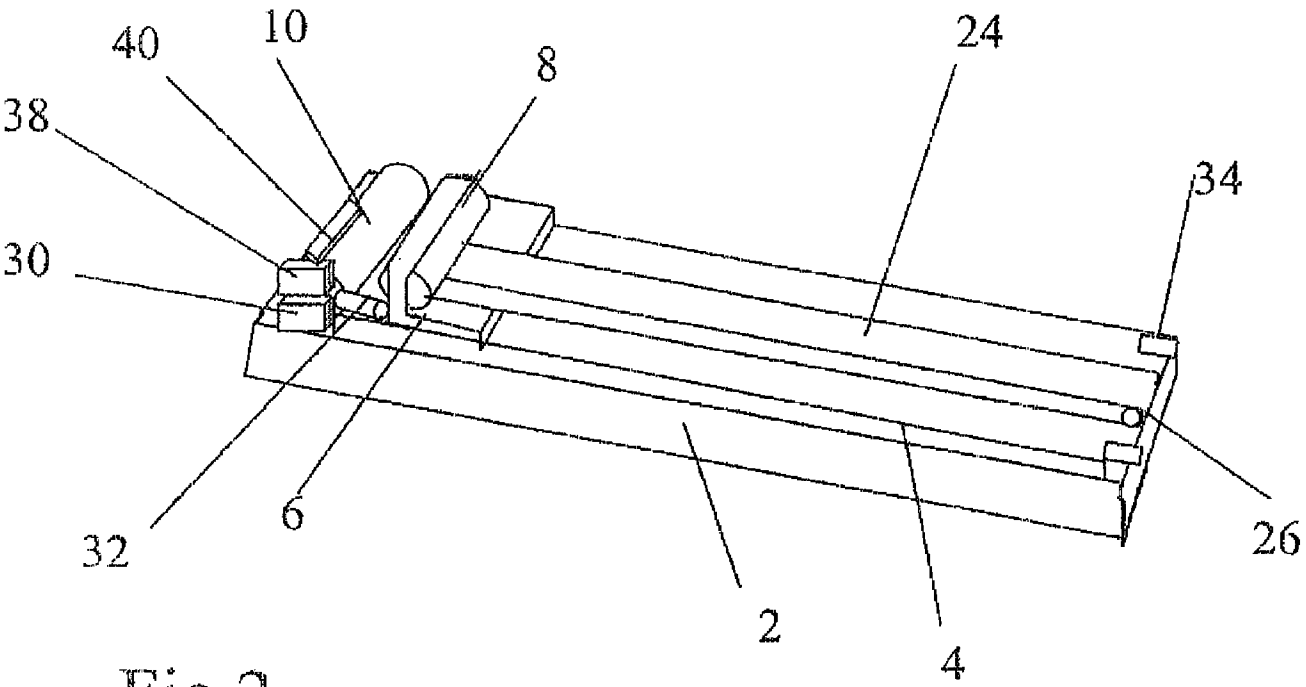
FIG. 2 is a schematic representation of the cradle mechanism of the system of FIG. 1.

Referring to FIG. 2, the cradle 6 is driven along the rails by a powered belt 24 driven by the motor 10. The belt 24 extends in a loop round a drive pulley on the shaft of the motor along the length of the chassis 2 and around a idler pulley on a fixed shaft 26 at the second end 14 of the chassis. The cradle 6 is fixed to a point on the belt so that it moves with the belt along the chassis. Controlling the torque of the motor controls the motion of the belt and hence the movement of the cradle 6.

Referring to FIGS. 1 and 2, the motor 10 includes a sensor 30, arranged to measure the rotational position of the motor and therefore to measure the position of the movable roller 8. The system also includes a controller 38 arranged to receive input signals from the position sensor 30 and control the current supplied to the motor to control the motor torque. It will be appreciated that the controller could be arranged to determine the position of the motor, and hence of the roller, from variations in the drive current applied to the motor.

Figure 3:
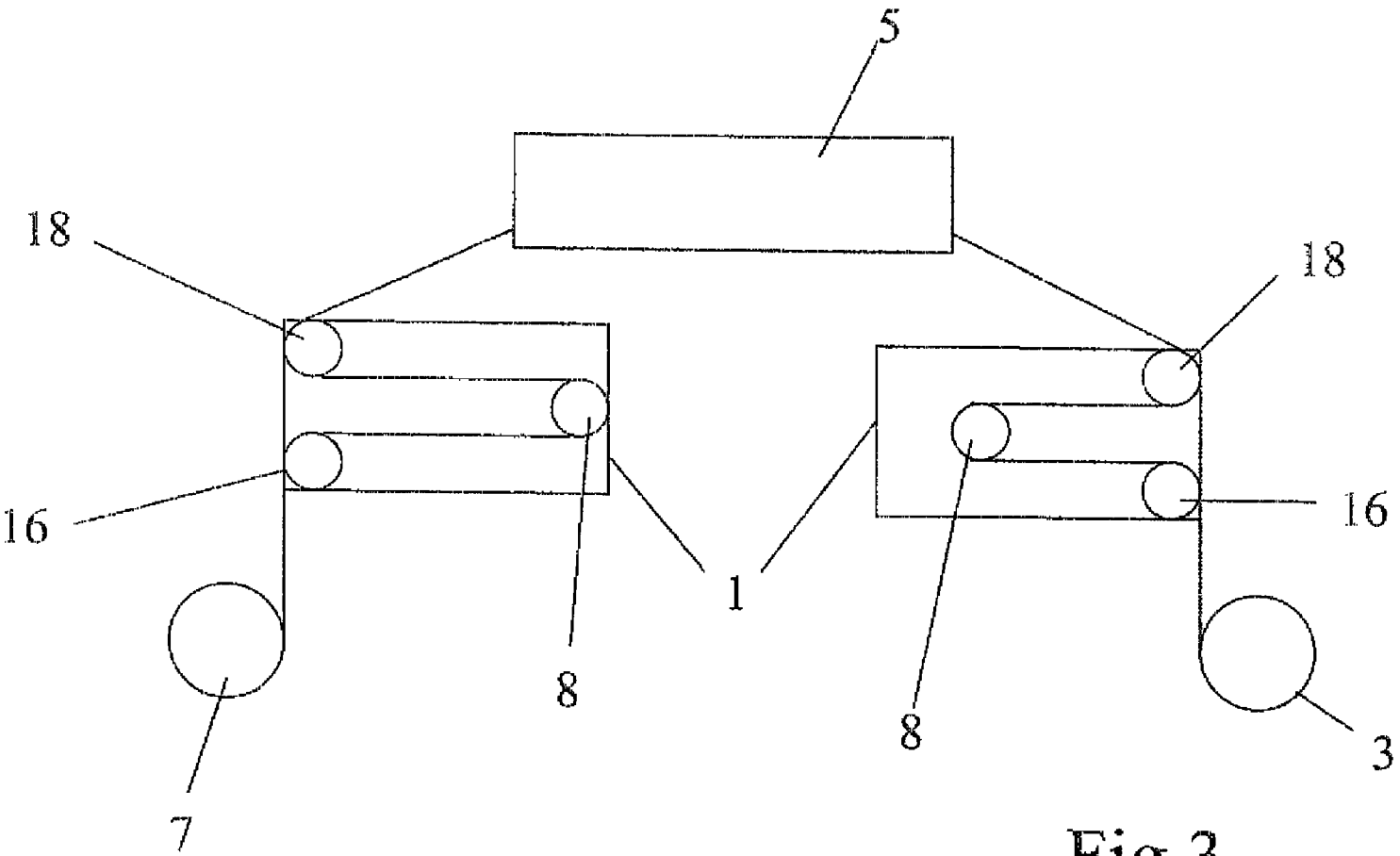
FIG. 3 is a schematic representation of a web press including the buffering and tension system of an embodiment of the present invention.

Referring to FIG. 3, the web substrate 22 is fed into the system at a substantially constant velocity by a web feed 3 and flows through a first buffering system 1 before entering the web press 5. A second buffering system is used at the output of the web press 5, which the substrate passes through before being collected on a collecting reel 7. In use in a selected printing cycle, the web substrate 22 moves during image transfer at a printing process speed, decelerates, stops and moves backwards and accelerates for the next printing image. This results in a difference in the web flow velocities at the web feed and the press input, and a difference in flow velocities between the output of the printing press and the collecting reel 7. It is the web substrate 22 accumulated due to the differences in web flow velocity that is accommodated in the web loop to avoid large variations in the tension of the web substrate. The sequence of variations of substrate velocity, and therefore the required web loop size and the position of the movable roller 8 at any point in time, is specific to each printing job and is dependent on parameters defined by the user, for example, the number of colours, substrate type and length of the image. The sequence of roller movements required to maintain the tension of the web substrate 22 during the specific sequence of variations of substrate velocity must therefore be determined.

A number of functions describing movements in the system are derived from the kinematics of the system, taking into account the geometry of the web press parts, and are stored in a memory. A user input 42 provides a request for a specific print job and this request defines the parameters of that printing job. A controller 38 receives the user input 42 that defines the parameters of the print job and inputs these parameters into the stored functions. The controller 38 then performs calculations to provide an output of the functions that defines the motion profile of the movable roller required to maintain the tension of the web substrate 22 within a particular range for that printing cycle. This sequence of roller movements is stored in the memory and the output of the motor 10 is controlled to achieve this stored sequence of roller movements. The current supplied to the motor 10 is controlled to control the torque of the motor to achieve the required motor output at any one time.

The current supplied to the motor 10 to achieve the required motion profile is controlled on the basis of a number of factors. A first component of the required current is defined as the current that is required to apply a certain amount of tension to the web substrate 22, assuming the cradle 6 is static and frictionless. A further component of the current is defined as the current required to apply a force to accelerate the cradle at the desired rate to achieve the desired movement within the desired sequence, and compensates for the inertia of the roller 8 and other associated moving parts of the system. This component can be calculated by solving the dynamics equations of the system, taking into account the acceleration of the drive belt, the web substrate and roller 8, as well as the cradle and any other associated moving parts.

An additional consideration is the friction of the system. The current must be controlled to include a friction component to overcome friction in the system. However, a component of the total frictional force varies with position of the cradle 6 as it moves through the predetermined sequence of movements. Of particular significance is friction from the continuous bending of the drive belt about the pulleys, the friction between the cradle 6 and the rails 4, friction in the motor 10 and in the idler pulley shaft. The current supplied to the motor 10 is therefore also controlled on the basis of this factor, which varies with the position and velocity of the cradle to compensate for changes in friction along the travel.

In one embodiment of the invention, the system further comprises a temperature sensor 40 arranged to sense the temperature of the motor. A change in the temperature of the motor results in a change in the moment coefficient of the motor, which, at a constant current supply, affects the torque of the motor. The controller is therefore arranged to control the current supplied to the motor in response to measured variations in the temperature to compensate for the resulting changes in the moment coefficient and maintain the desired motor torque.

The total current supplied to the motor can be described using the expression:

$$I=[I_T+I_a+I_f(p,v)]*\text{Motor Temperature Factor}$$

where $I_T$ is the current component dependent on tension which is desired to be maintained in the substrate;

$I_a$ is the current component dependent on desired acceleration; and $I_f(p,v)$ is the current component dependent on friction.

The sensor 30 is arranged to continuously measure the position of the motor and thereby continuously measure the translational position of the roller 8. The system operates as a closed loop velocity control system and continuously controls the current supplied to the motor 10 using the controller 38 in response to the factors discussed above to control the torque required to achieve the desired change in cradle 6 velocity, and hence the desired change in roller 8 velocity to maintain the desired tension in the web substrate 22.

When first used, the system moves through a calibration cycle, in which the system learns how the friction varies as a function of position and velocity, learns the inertia of the system, and learns the required variations to the motor output torque to compensate for these. The design of the system is such that the friction does not change significantly over time and this calibration cycle need not be carried out frequently.

The cradle is supported on linear bearings (not shown) that slide on the rails 4, that minimise the friction and noise of the system and that are suitable for the high velocity operation of the new generation of web presses. This minimisation of friction, together with the compensation for any changes in friction as described above, significantly reduces any tension variability in the web substrate 22.

The moving parts of the system, such as the cradle 6, are selected to have a very low mass to minimise forces transmitted to other parts of the web press due to inertial forces produced. The minimal mass of the moving parts also reduces the size of motor that is required. The movable roller 8 is designed to have a low rotational inertia but also has a diameter that is large enough to support the handling of a variety of substrates including paper, plastic materials, metals and magnetic materials of varying substrate thickness. For example, the system is able to support a substrate thickness in the range of 12 microns to 700 microns. Additionally, the stiffness of the roller and the accuracy of alignment of the cradle to move in a straight line with respect to the chassis minimises impairments to the web substrate flow.

In one embodiment the controller has different control settings arranged for use with different substrates. This is because different materials and thicknesses of substrate will have different weights and frictional characteristics, and therefore the torque required from the motor to produce a given speed or acceleration of the movable roller will be slightly different. These different settings are learnt at the calibration cycle and may include different control loop parameters accordingly.

The system includes limit switches 32 that detect the end of travel of the cradle 6 along the rails 4. The limit switches are mounted onto the chassis 6 on each side of the first end 12 and the second end 14 such that those at the first end detect the end of travel of the cradle in a direction towards the first end of the chassis and those at the second end 14 detect the end of travel of the cradle 6 in a direction away from the first end 12 of the chassis 2. Referring to FIG. 2, energy absorbers and hard stops 34 are also included at both ends of travel.

The bi-directional movement of the web substrate 22 through the web press results in variations in the web flow velocity both at an input side and an output side of the web press. Accordingly, the system ideally includes the buffering and tension control system described above at both the input and output sides of the web press. The two buffering system can be mounted onto separate chassis. Alternatively, the input buffering system and output buffering system can be mounted onto the upper side and underside of a single chassis. For example, referring to FIG. 1, a second motor 36 is mounted to the underside of the chassis 2 at its second end 14. A movable cradle slides on rails (not shown) mounted underneath the chassis and supports a second movable roller. This operates in the same manner as the system described above.

The current supplied by the controller 38 to the motor can be monitored, for example by the controller 38 to detect irregularities. Any irregularities may be indicative of a fault and this monitoring can therefore be used in fault detection, diagnostics and troubleshooting.

It will be appreciated that variations may be made to the embodiments described above within the scope of the invention. For example, the position of the roller 8 may be determined using any suitable sensing means such as a light sensor or potentiometer. The current supplied to the motor may be controlled to maintain the torque of the motor in response to variations in additional parameters not described above. For example, the system may include a sensor arranged to directly measure the tension of the substrate and variations in the tension of the substrate and the controller may operate as a closed loop tension control system to control the motor torque in response to changes in the measured tension thereby to maintain the tension at a target level.

We claim:

1. A method of buffering and controlling tension of a print substrate moving through a web press with a sequence of variations in substrate velocity during a printing cycle, using a control system comprising a chassis, and first and second movable rollers and motors, the method comprising:

supporting a loop of the print substrate on the first movable roller for an input side of the web press;

receiving at least one function that defines a motion profile of the first and second movable rollers required to maintain tension of the print substrate;

controlling, via the first motor, translational movement of the first movable roller, based on the at least one received function, relative to a position of the first motor to control the tension of the print substrate on the input side of the web press in a first direction;

controlling output of the first motor, based on the at least one received function, to achieve a sequence of movements of the first movable roller arranged to control the tension of the print substrate on the input side of the web press based on the sequence of variations in velocity of the print substrate;

supporting a further loop of the print substrate on the second movable roller for an output side of the web press;

controlling, via the second motor, translational movement of the second movable roller, based on the at least one received function, relative to a position of the second motor to control the tension of the print substrate on the output side of the web press in a second direction that is generally opposite to the first direction to add tension to the print substrate, and in a generally same direction as the first direction to reduce tension in the print substrate; and controlling output of the second motor, based on the at least one received function, to achieve a sequence of movements of the second movable roller arranged to control the tension of the print substrate on the output side of the web press based on the sequence of variations in velocity of the print substrate.

2. A method according to claim 1, comprising receiving a user input, determining the at least one function and the sequence of movements of the first and second movable rollers on a basis of the user input and controlling the first and second movable rollers to follow the sequence of movements of the first and second movable rollers.

3. A method according to claim 2, comprising measuring positions of the first and second movable rollers and controlling the outputs of the first and second motors in response to the measured positions to control velocity of the first and second movable rollers to achieve the sequence of movements of the first and second movable rollers.

4. A method according to claim 1, wherein the outputs of the first and second motors are controlled on the basis of a factor, which depends on the desired tension of the substrate.

5. A method according to claim 1, wherein the outputs of the first and second motors are controlled on a basis of a factor which varies with a desired acceleration of at least the first and second movable rollers.

6. A method according to claim 1, wherein the outputs of the first and second motors are controlled on a basis of factors that account for friction from continuous bending of drive belts about pulleys used for the first and second movable rollers.

7. A method according to claim 1, comprising moving the control system through a calibration cycle during which the system learns a sequence of variations of friction as a function of at least one of a position and velocity of the first and second movable rollers and learns an inertia of the system.

8. A method according to claim 1, further comprising sensing temperatures of the first and second motors and controlling current supplied to the first and second motors in response to any changes in the temperatures to maintain the outputs of the first and second motors.

9. A method according to claim 1, wherein the outputs of the first and second motors are controlled by controlling current supplied to the first and second motors, the method further comprising monitoring the supplied current to detect irregularities indicative of a fault.

10. A method according to claim 1, further comprising determining a required web loop size of the print substrate based on print parameters defined by a user, wherein the print parameters include a number of colors to be printed, a print substrate type, and dimensions of an image to be printed.

11. A method according to claim 1, further comprising determining currents to be supplied to the first and second motors based on a required amount of tension to be applied to the print substrate for static and frictionless cradles that support the first and second movable rollers, and further based on forces to accelerate the cradles at desired rates to achieve a desired movement and to compensate for inertia of the first and second movable rollers.

12. A method according to claim 1, further comprising sensing the positions of the first and second motors to measure positions of cradles supporting the first and second movable rollers.

13. A method according to claim 1, further comprising sensing rotational positions of the first and second motors to measure positions of the first and second movable rollers.

14. A method according to claim 1, further comprising determining the positions of the first and second motors to determine positions of the first and second movable rollers based on variations in the drive currents applied to the first and second motors.

15. A control system for buffering and tension control of a length of print substrate passing through a web press, the control system comprising:

a chassis;

first and second movable rollers movably supported on the chassis and arranged to support a loop of the print substrate;

first and second motors configured to produce translational movement of the first and second movable rollers relative to the positions of the first and second motors;

a measuring device configured to measure the translational positions of the first and second movable rollers; and a controller configured to:

receive at least one function that defines a motion profile of the first and second movable rollers required to maintain tension of the print substrate; and control the first and second motors, based on the at least one received function, to achieve a sequence of movements of the first and second movable rollers to maintain tension based on a sequence of variations in substrate velocity of the print substrate, wherein the first and second movable rollers move in generally opposite directions to add tension to the print substrate, and in a generally same direction to reduce tension in the print substrate.

16. The system of claim 15, comprising an input device configured to enable a user to provide a user input, wherein the controller is configured to receive the user input, determine the at least one function, and calculate the sequence of movements of the first and second movable rollers on the basis of the user input.

17. The system of claim 15, comprising a temperature sensor configured to sense temperature of the first and second motors, wherein the controller is configured to control current supplied to the first and second motors in response to variations in the temperature of the first and second motors to maintain output of the first and second motors.

18. The system of claim 15, wherein the controller is configured to control output of the first and second motors on the basis of at least one of a first factor which depends on a desired tension of the substrate, a second factor which varies with acceleration of at least the first and second movable rollers, and a third factor which varies with at least one of a position and the velocity of the first and second movable rollers so as to compensate for any changes in friction.

19. The system of claim 15, comprising at least two first fixed rollers, wherein the first movable roller is configured to tension the substrate against the first fixed rollers.

20. A method of buffering and controlling tension of a print substrate moving through a web press with a sequence of variations in substrate velocity during a printing cycle, using a control system comprising a chassis, and first and second movable rollers and motors, the method comprising:

supporting a loop of the print substrate on the first movable roller on a first side of the chassis, designated an input side of the web press;

controlling, via the first motor, translational movement of the first movable roller relative to a position of the first motor to control the tension of the print substrate on the input side of the web press in a first direction relative to the chassis;

controlling output of the first motor to achieve a sequence of movements of the first movable roller arranged to control the tension of the print substrate on the input side of the web press based on the sequence of variations in velocity of the print substrate;

supporting a further loop of the print substrate on the second movable roller on a second opposite side of the chassis, designated an output side of the web press;

controlling, via the second motor, translational movement of the second movable roller relative to a position of the second motor to control the tension of the print substrate on the output side of the web press in a second direction that is generally opposite to the first direction to add tension to the print substrate, and in a generally same direction as the first direction to reduce tension in the print substrate; and controlling output of the second motor to achieve a sequence of movements of the second movable roller arranged to control the tension of the print substrate on the output side of the web press based on the sequence of variations in velocity of the print substrate.

* * * * *